US005226597A

United States Patent [19]

Ursic

[11] Patent Number: 5,226,597

[45] Date of Patent: Jul. 13, 1993

[54] ORIFICE ASSEMBLY AND METHOD PROVIDING HIGHLY COHESIVE FLUID JET

[76] Inventor: Thomas A. Ursic, 12 Bedford Dr., West Trenton, N.J. 08628

[21] Appl. No.: 988,401

[22] Filed: Dec. 16, 1992

Related U.S. Application Data

[63] Continuation-in-part of Ser. No. 760,871, Sep. 16, 1991.

[51] Int. Cl.[5] ..... B05B 17/04; B05B 1/34

[52] U.S. Cl. ..... 239/11; 239/590.5; 239/590; 239/596; 239/DIG. 19

[58] Field of Search ..... 239/590, 596, 591, 589, 239/DIG. 19, 600, 601, 1, 11, 590.5

[56] References Cited

U.S. PATENT DOCUMENTS

| | | | |
|---|---|---|---|
| 3,386,521 | 6/1968 | Chadderdon et al. . | |
| 3,419,220 | 12/1968 | Goodwin et al. . | |
| 3,705,693 | 12/1972 | Franz | 239/600 |
| 3,750,961 | 8/1973 | Franz | 239/596 |
| 3,756,106 | 9/1973 | Chadwick et al. | 239/590 |
| 3,997,111 | 12/1976 | Thomas et al. | 239/601 |
| 4,244,521 | 1/1981 | Guse | 239/596 |
| 4,313,570 | 2/1982 | Olsen | 239/596 |
| 4,392,534 | 7/1983 | Miida | 239/591 |
| 4,567,954 | 2/1986 | Voight, III et al. | 239/600 |
| 4,638,327 | 1/1987 | Sutera et al. | 239/590.5 |
| 4,852,800 | 8/1989 | Murdock | 239/1 |
| 4,936,512 | 6/1990 | Tremoulet, Jr. | 239/596 |
| 5,033,681 | 7/1991 | Munoz | 239/596 |

FOREIGN PATENT DOCUMENTS

| | | | |
|---|---|---|---|
| 2903733 | 8/1980 | Fed. Rep. of Germany . | |
| 1199271 | 12/1985 | U.S.S.R. | 239/596 |
| 1517769 | 7/1978 | United Kingdom | 239/596 |

OTHER PUBLICATIONS

IBM Technical Disclosure Bulletin, vol. 18, No. 5 Oct, 1975.

Scientific American, Diamonds in Oil Burners, Jul. 1933.

*Primary Examiner*—Andres Kashnikow
*Assistant Examiner*—Christopher G. Trainor
*Attorney, Agent, or Firm*—Ostrolenk, Faber, Gerb & Soffen

[57] ABSTRACT

Apparatus for receiving a fluid under pressure and providing a highly cohesive fluid jet stream. The apparatus has a housing receiving fluid from a supply tube supplying fluid under pressure to the housing. The housing has a passageway therein through which the fluid flows, the passageway having an orifice therein formed by an opening in an orifice element for producing the fluid jet. The orifice element has an upstream portion, the passageway further having a converging section disposed upstream of the orifice for reducing turbulence in the passageway upstream of the orifice. The converging section extends toward the orifice element, reducing turbulence upstream of the orifice and thus providing a more cohesive fluid jet downstream of the orifice. A section having a rounded surface is disposed between the converging section and the orifice element and joins the converging section and upstream portion of the orifice element, thereby improving cohesiveness of the exiting fluid jet by further reducing turbulence upstream of the orifice.

20 Claims, 4 Drawing Sheets

ORIFICE ASSEMBLY AND METHOD PROVIDING HIGHLY COHESIVE FLUID JET

CROSS REFERENCE TO RELATED APPLICATION

This application is a continuation-in-part of applicant's copending U.S. application, Ser. No. 07/760,871, filed Sep. 16, 1991.

BACKGROUND OF THE INVENTION

The present invention relates to a method and apparatus for providing high pressure fluid jet streams and, in particular, the invention relates to an orifice assembly for providing a highly cohesive fluid jet, e.g. a water jet. Such fluid or water jets are now used for cutting of various materials, including hard materials such as stone and concrete, and softer materials such as, for example, plastics and leather.

In the past, a problem with devices producing high pressure fluid jets is that the cohesiveness of the jet, i.e., the convergence of the velocity vectors of the fluid making up the fluid jet, only extends for a relatively short distance. Being able to create a more cohesive or convergent fluid jet allows for finer fluid jet streams and, accordingly, more precise cutting, as well as the ability to allow the fluid jet nozzle to be disposed at a greater distance from the object being cut or to cut more deeply. This is particularly important in the robotics area, for example, where a fluid jet must closely follow the contour of the object being cut because of the small distance over which the fluid jet is cohesive. At greater distances from the object, the fluid jet becomes more turbulent, providing a wider kerf or width of cut, and, if too turbulent, thereby reducing the precision of the cut, or reducing the ability to cut the material at all. It has been observed that a reason for the lack of cohesiveness of a cutting jet is the presence of turbulence upstream of the orifice through which the cutting jet emerges. In addition to the above problems, the presence of turbulence may result in undesirable wetting of the material being cut.

Several devices have been proposed in the past for solving this problem. One is disclosed in U.S. Pat. No. 3,997,111, in which a lengthy liquid collimating device is disposed upstream of the nozzle orifice and wherein the flow collimating chamber is at least one hundred times greater than the cross-sectional area of the nozzle opening.

In another proposal, U.S. Pat. No. 4,852,800, a convergent section is disposed upstream of the orifice to reduce the turbulence upstream of the orifice and thereby provide a more convergent fluid jet downstream of the orifice.

Although the above devices help to provide a more cohesive fluid jet from the fluid jet orifice, they suffer from a number of disadvantages. The collimating chamber of the '111 patent is disadvantageous for its size and weight. The device of the '800 patent requires modifications to be made to the collimating chamber of the nozzle or fluid supply tube by the provision of a conical section upstream of the orifice.

In one commercially-available fluid jet producing device, the supply tube to the fluid jet producing orifice is approximately 3/16 inch. In another commercial design, the supply tube is approximately ¼ inch. The larger, ¼ inch supply tube provides less turbulence to the nozzle orifice than the 3/16 inch supply tube. The larger supply tube, therefore, provides a more cohesive fluid jet from the orifice than those devices provided with the smaller diameter supply tube.

SUMMARY OF THE INVENTION

It is, accordingly, an object of the present invention to provide an orifice assembly for producing a highly cohesive fluid jet.

It is yet still a further object of the present invention to provide, according to an embodiment of the invention, such an orifice assembly for generating a highly cohesive fluid jet which can be conveniently and easily attached to conventional high pressure fluid supply tubes, without any modifications being made to the tube other than the attachment of the orifice assembly to the supply tube in place of the conventional orifice assembly.

It is yet still a further object of the present invention to provide such an orifice assembly for generating a highly cohesive fluid jet which allows those devices having smaller diameter supply tubes, e.g., the 3/16 inch supply tube, to be retrofitted by the device of the invention, thereby allowing these devices to provide more cohesive fluid jets.

It is still another object according to an embodiment of the invention to provide an orifice assembly wherein the orifice element is disposed in the screw-on housing fastened to the end of the fluid supply tube.

It is yet still a further object of the present invention to provide an orifice assembly which improves on previous orifice assemblies having turbulence reduction portions, including the device shown in U.S. Pat. No. 4,852,800, as well as the device shown in my copending application, Ser. No. 07/760,871, filed Sep. 16, 1991

The above and other objects of the present invention are achieved by an apparatus for receiving a fluid under pressure and providing a highly cohesive fluid jet stream therefrom, comprising a housing for fastening to a supply tube supplying fluid under pressure to the housing, the housing having a passageway therein through which the fluid flows, the passageway having an orifice therein formed by an opening in an orifice element for producing the fluid jet, the orifice element having an upstream surface, the passageway further having a converging section disposed upstream of the orifice for reducing turbulence in the passageway upstream of the orifice, the converging section extending to the upstream surface of the orifice element, thereby providing a more cohesive fluid jet downstream of the orifice, the converging section being disposed in the housing receiving the orifice, the housing being a separate part from the supply tube.

According to another aspect, the invention provides an apparatus for attaching to a fluid supply tube having a substantially constant internal diameter and for receiving a fluid from the supply tube under pressure and providing a highly cohesive fluid jet stream therefrom, comprising a housing for fastening to a supply tube supplying fluid under pressure to the housing, the housing having a passageway therein through which the fluid flows, the passageway having an orifice therein formed by an opening in an orifice element for producing the fluid jet, the orifice element having an upstream surface, the passageway further having a converging section disposed upstream of the orifice for reducing turbulence in the passageway upstream of the orifice, the converging section extending to the upstream surface of the orifice element, thereby providing a more cohesive fluid jet downstream of the orifice, said converging section being disposed in the housing as an integral part of the housing, the housing being a separate part from said supply tube and retaining the orifice element in position in the passageway.

According to yet still another aspect, the invention provides a method for producing a highly cohesive fluid jet comprising receiving fluid under pressure through a supply tube, providing a housing at the end of the supply tube having a passageway with an orifice formed by an opening in an orifice element in the passageway, the orifice element having an upstream surface, providing a converging section in the passageway in the housing containing the orifice upstream of the orifice for reducing turbulence in the fluid near the orifice, the converging section extending to the upstream surface of the orifice element, thereby providing a more cohesive fluid jet downstream of the orifice.

According to a further aspect, the invention apparatus for receiving a fluid under pressure and providing a highly cohesive fluid jet stream therefrom comprising a housing receiving fluid from a supply tube supplying fluid under pressure to the housing the housing, having a passageway therein through which the fluid flows, the passageway having an orifice therein formed by an opening in an orifice element for producing the fluid jet, the orifice element having an upstream portion, the passageway further having a converging section disposed upstream of the orifice for reducing turbulence in the passageway upstream of the orifice, the converging section extending toward the orifice element, a section having a rounded surface being disposed between the orifice element and the converging section and joining the converging section and the upstream portion of the orifice element, thereby providing a more cohesive fluid jet downstream of the orifice,.

According to yet a further aspect, the invention relates to a method for producing a highly cohesive fluid jet comprising receiving fluid under pressure through a supply tube, providing a housing at the end of the supply tube having a passageway with an orifice formed by an opening in an orifice element in the passageway, the orifice opening having an upstream portion, and providing a converging section in the passageway upstream of the orifice for reducing turbulence in the fluid near the orifice, the converging section extending toward the orifice element, and further comprising providing a rounded surface between the converging section and the upstream portion of the opening of the orifice element, the rounded section joining the converging section and the orifice element upstream portion, thereby providing a more cohesive fluid jet downstream of the orifice..

Other features and advantages of the present invention will become apparent from the following detailed description of the invention.

BRIEF DESCRIPTION OF THE DRAWINGS

The invention will now be described in greater detail in the following detailed description with reference to the drawings in which.

DETAILED DESCRIPTION OF THE DRAWINGS

Figure 1:
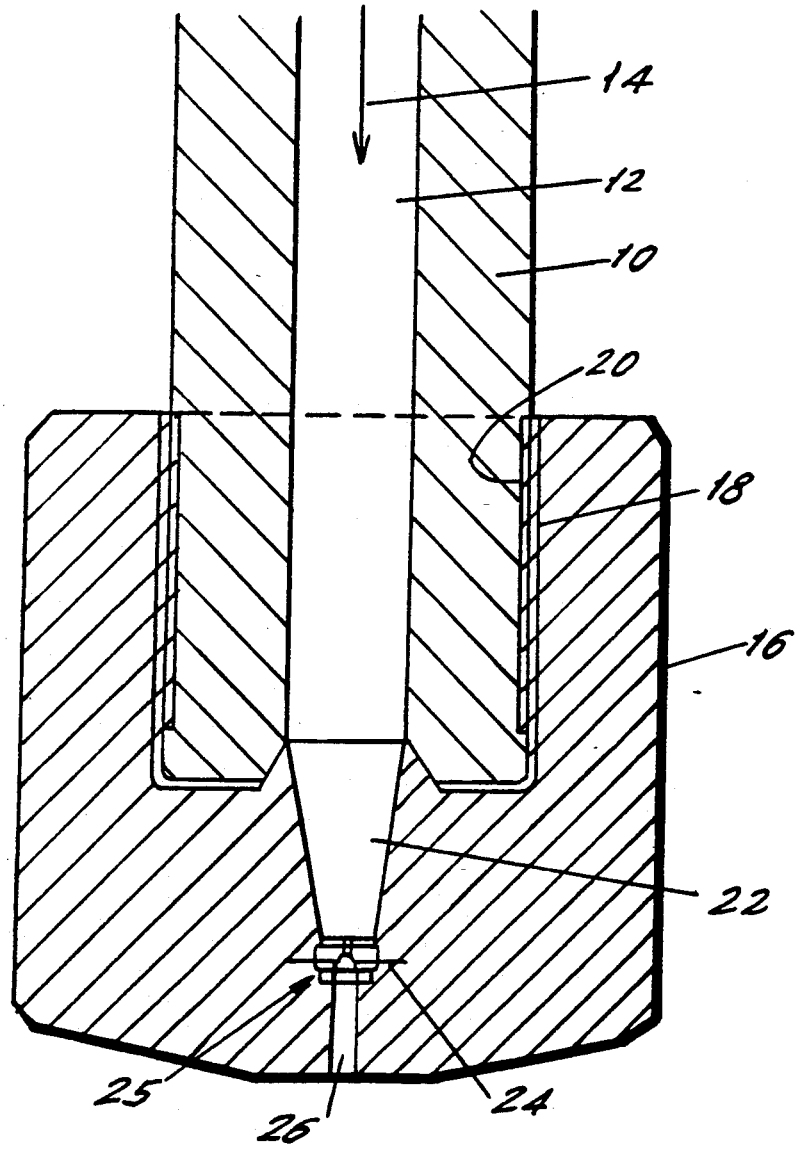
FIG. 1 is a cross section through the high cohesiveness orifice assembly according to the present invention.

With reference now to the drawings, the high cohesiveness orifice assembly according to the present invention is shown in FIG. 1. The conventional fluid supply tube is depicted at 10, and the supply tube bore for providing high pressure fluid to the orifice is shown at 12. The direction of fluid flow is indicated by the arrow 14.

An orifice housing 16 is provided which has internal threads 18 in a cavity 17 engaging external threads 20 provided on the supply tube. The orifice housing 16 may be made of metal and includes a converging section 22 opening into cavity 17 receiving supply tube 10, the converging section 22 preferably having a conical taper having its smaller diameter terminating at an orifice 24. Orifice 24 typically may be a sapphire jewel, for its extreme hardness and ability to withstand the tremendous pressures from the fluid, which may be greater than 50,000 psi. The orifice preferably is disposed on an orifice support 25, which may be a flexible protective support as disclosed in applicant's copending application Ser. No. 07/760,616 filed concurrently herewith. Downstream of the orifice 24, a nozzle opening 26 is provided through which the fluid stream is emitted.

Figure 2:
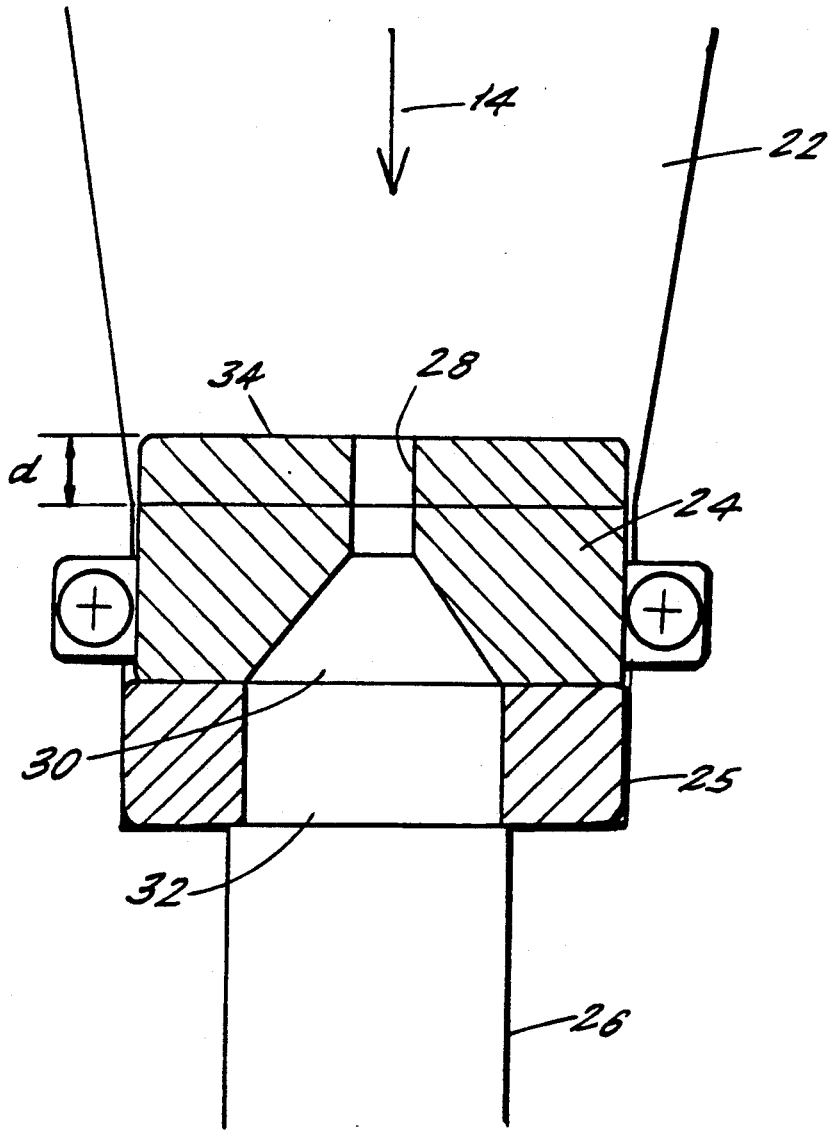
FIG. 2 is a detail of the cross section of the high cohesiveness orifice assembly according to the present invention.

As shown in FIG. 2, the orifice 24 is typically provided with a cross-section having an initial straight section 28, followed by a diverging section 30. An additional straight section 32 of the support 25 has a diameter greater than section 28 and equal to the larger diameter of the diverging section 30.

In accordance with an aspect of the invention, it has been found preferable to dispose the surface 34 of the orifice 24 a small distance d into the converging section 22. The reason for this will be explained in greater detail below.

Figure 3:
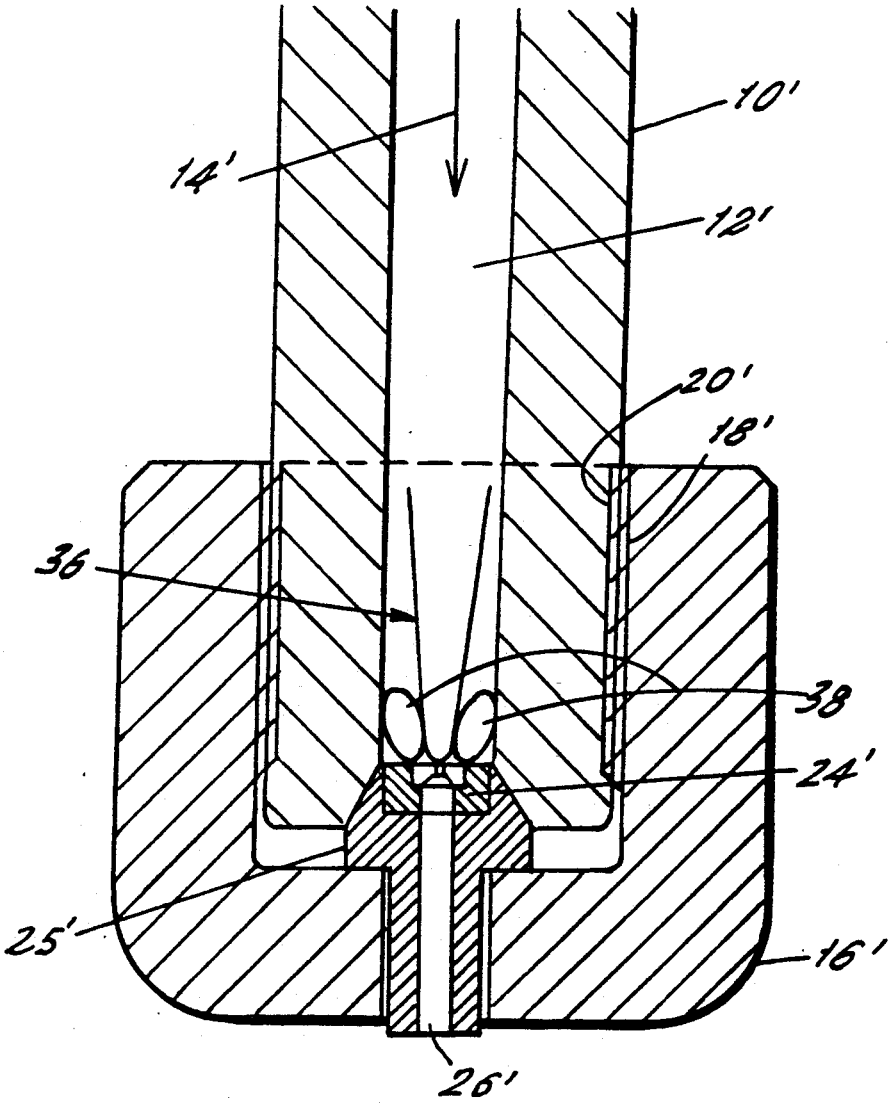
FIG. 3. (PRIOR ART)
FIG. 3 is a cross section through a prior art fluid jet orifice mounting configuration showing the fluid velocity profile and turbulent eddy currents generated in the fluid supply tube by the square end surface of the orifice and the rapidly moving fluid through the orifice.
Figure 4:
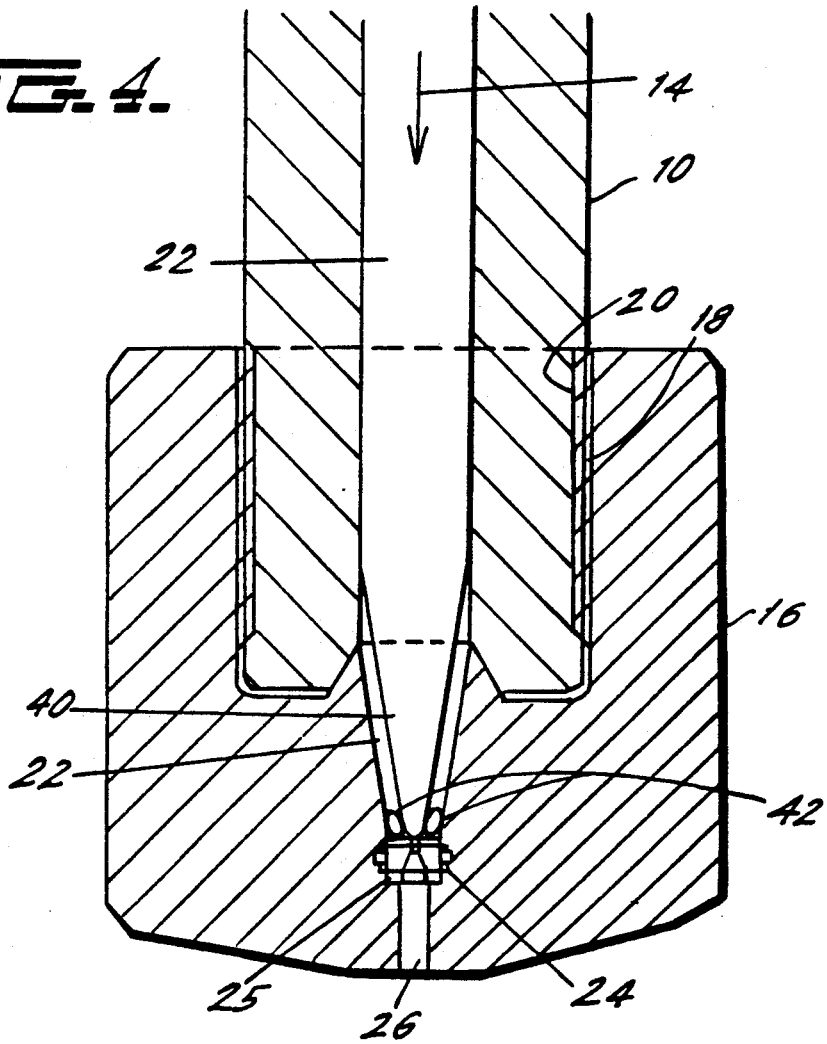
FIG. 4 is a cross section through the high cohesiveness orifice assembly according to the present invention showing the fluid velocity profile and smaller eddy currents induced in the device according to the present invention.

FIGS. 3 and 4 will be used to explain why the present invention provides advantages over the prior art devices wherein the fluid is supplied to the orifice through a substantially straight supply tube. As discussed above, it is already known that a converging section may be provided ahead of the orifice, as shown in U.S. Pat. No. 4,852,800. However, this reference requires modifications to be made to the supply tube in that a collimating cone must be provided in the supply tube itself or a special section including the converging section be disposed ahead of the orifice assembly. The present invention eliminates the need to modify the supply tube or provide a special assembly ahead of the orifice assembly, and, instead, a user simply screws the orifice assembly of the present invention onto a conventional straight supply tube (replacing the conventional orifice assembly) to achieve the effects provided by a converging section upstream of the orifice.

As shown in FIG. 3, in the conventional supply tubes 10' having a constant internal diameter, the velocity profile of the high pressure fluid flow 14' near the orifice 24' is as shown by reference numeral 36. Because of the substantially square end configuration provided by the orifice 24' at the end of the supply tube bore 12', eddy currents, shown by the ovals at 38, are generated. This means that the flow near the upstream orifice surface is turbulent, and this reduces the cohesiveness or extent of cohesiveness of the fluid jet provided at the outlet of the nozzle 26'. In FIG. 3, orifice 24' is shown supported by a fixed support 25' in a housing 16'. Housing 16' screws into supply tube 10', by way of mating screw threads 18' and 20'.

In the high cohesiveness orifice assembly according to the present invention, as shown in FIG. 4, the converging section 22 approximates the velocity profile 40 of the high pressure fluid. Because of the smaller end section of the converging section 22, which is approximately the diameter of the orifice jewel 24, less turbulence, shown by smaller eddy currents 42, is created. This reduction in the turbulence upstream of the orifice 24 allows for a more cohesive fluid jet to emerge from the nozzle 26.

It has also been found that, by disposing the upstream surface 34 of the orifice assembly 24 into the converging section 22 by a small distance d, as shown in FIG. 2, the cohesiveness of the fluid jet is not impaired and possibly may be improved. The small distance d may be approximately 0.008 inch, but less than 0.015 inch. This is thought to be due to the fact that the orifice upstream surface 34 protrudes into the region of laminar flow of the fluid, which thereby reduces the turbulence of the fluid entering the orifice and increases the cohesiveness of the fluid jet emerging therefrom. If the surface 34 protrudes too far into the converging section 22, however, the cohesiveness is impaired.

Referring to FIG. 4, another advantage provided by the present invention is that the orifice is located closer to the end of the housing 16 than in the prior art arrangement shown in FIG. 3. This allows the orifice to be disposed closer to the work, thereby providing a longer, more cohesive fluid jet to the work. For example, in the device shown in FIG. 4, the downstream surface of orifice 24 is approximately ⅛ inch from the end of the nozzle housing. In the device of FIG. 3, the same distance is about ⅜ inch, resulting in a less cohesive fluid jet applied to the work.

The present invention provides significant advantages over the prior art device shown in FIG. 3, as well as the devices shown in the '800 and '111 patents. In particular, the present invention provides an orifice assembly which fastens directly to the end of a conventional supply tube with a single screw-on assembly. The use of the invention requires no modifications to be made to the conventional constant internal diameter supply tubes currently in use and does not require that a special assembly be mounted ahead of the orifice. Instead, a user simply mounts the single assembly of the invention to the conventional supply tube.

The present invention thus provides advantages over the device of the '800 patent, as it does not require modification of the supply tube and can be installed on conventional constant internal diameter supply tubes and, in particular, the smaller 3/16 inch diameter supply tubes currently in use, to give these devices employing the smaller supply tubes the advantages provided by the larger diameter supply tubes.

Figure 5:
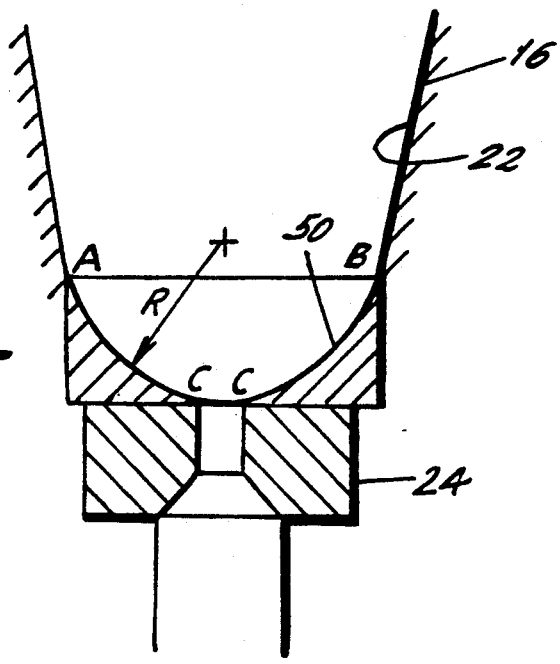
FIG. 5 is a cross section through a portion of a further embodiment of the high cohesiveness orifice assembly according to the present invention showing a modification of the invention to improve turbulence reduction and improve fluid jet cohesiveness even further.
Figure 4:
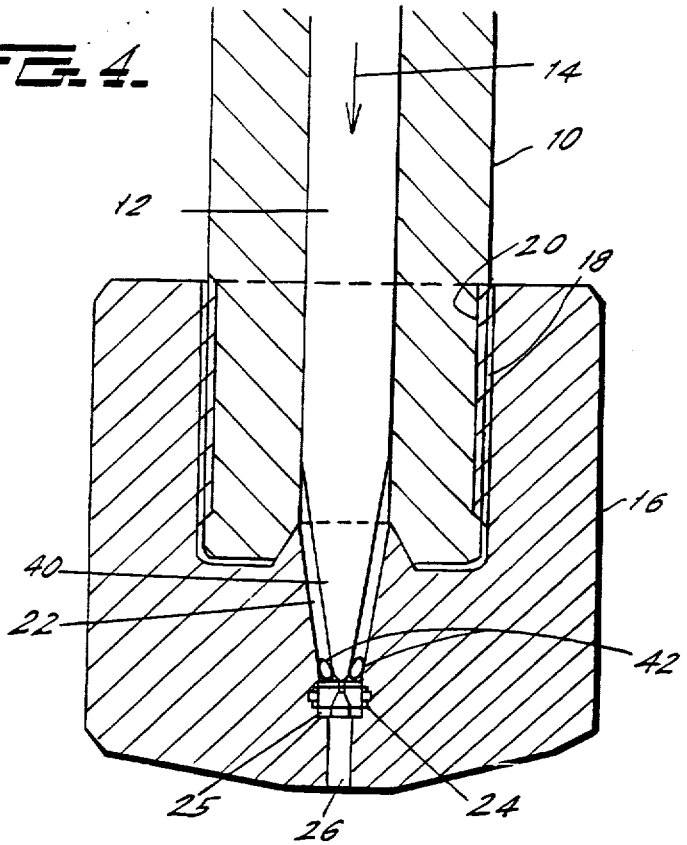
Figure 5:
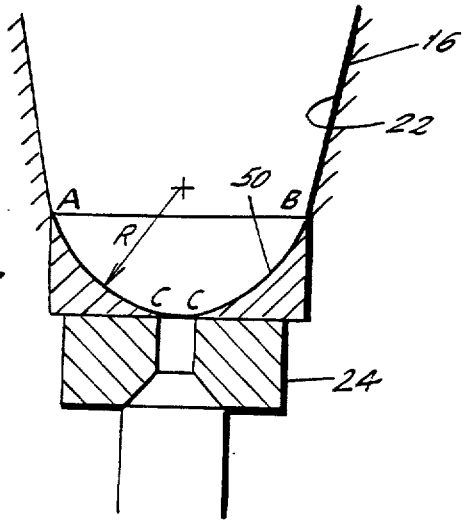

FIG. 5 shows a modification of the invention which improves the turbulence reduction and cohesiveness of the fluid jet even further. As shown in FIG. 5, at the end of tapering section 22, the tapering section terminates in a spherical surface 50. The spherical surface 50 may be a surface of a separate insert 52 from the housing 16, or it may be formed or machined into the housing 16 when the tapering section 22 is made. The cup shaped section 52, if a separate section, may be adhesively coupled to the housing 16. The section 52 can be made of a metal. Alternatively, section 52 may be formed of a substance which is flowable but which subsequently hardens into the shape shown or the spherical shape can be later machined or formed onto the section 52. For example, the section 52 could be made of a suitable thermo plastic or adhesive material. In another modification, the section 52 can be formed in one piece with the orifice element 24, and thus can be made of the same hard sapphire material as the orifice element 24.

Experimentation with various methods of retaining the orifice 24, shown in FIG. 5 without a support 25, involved the use of adhesives and epoxies. It was noticed that certain adhesive bonded orifices had substantially better flows than those in which an adhesive was not used. Careful removal and examination of the shape of the formed adhesive upstream of the orifice revealed a spherical shape. It was thought by the inventor, however, that perhaps the improved flow was due to the use of the adhesive absorbing any orifice vibration. The use of a metal spherical cup upstream of the orifice and assembly of the orifice without adhesive provided identical results to that with adhesive, so it does not appear that absorption of vibration caused the improved results. Instead, it appears that the rounded shape of the surface 50 provides the improved results. The advantage of using metal was that the adhesive would wear out in a very short time, whereas the metal would last for a substantially much longer period of time. Experiments with metal cups have shown that the metal cups last practically as long as the sapphire orifices 24 themselves.

Referring to FIG. 5, it was determined that the preferred shape of the cup shaped section 52 at the end of the tapering section 22 was obtained by providing a cup radius R determined by the tangent points A and B on the tapering section 22 and tangent points C at the face of the orifice adjacent the opening in the orifice. The tangent points A, B and C of the cup shaped section 52 preferably should blend with as smooth a transition as possible with the respective surfaces of the tapering section 22 and the orifice element 24. This will facilitate continuous uninterrupted fluid flow.

It was also discovered that slightly roughening the cup surface 50 by bead blasting improved fluid jet cohesiveness. This is apparently due to the induced turbulence created by the rough surface in the fluid boundary layer. This turbulent boundary layer near the rough surface prevents fluid separation and the resulting mainstream turbulence and eddy currents.

It is believed that the spherical cup section 52 provides an improved fluid jet cohesiveness by further stabilizing the fluid upstream of the orifice.

The embodiment of the invention shown in FIG. 5 provides an improvement in fluid jet cohesiveness for any known fluid jet producing devices, in that the spherical surface adjacent the upstream surface of the orifice element further reduces turbulence and improves the cohesiveness of the fluid jet exiting the device. Thus this embodiment of the invention could be used, as shown with the nozzle of FIGS. 1, 2 and 4, and also with prior art devices such as shown in FIG. 3 or as shown in U.S. Pat. No. 4,852,800.

In the foregoing specification, the invention has been described with reference to specific exemplary embodiments thereof. It will, however, be evident that various modifications and changes may be made thereunto without departing from the broader spirit and scope of the invention as set forth in the appended claims. The specification is, accordingly, to be regarded in an illustrative rather than a restrictive sense.

What is claimed is:

1. Apparatus for receiving a fluid under pressure and providing a highly cohesive fluid jet stream therefrom comprising:

a housing receiving fluid from a supply tube supplying fluid under pressure to the housing;

the housing having a passageway therein through which the fluid flows, the passageway having an orifice therein formed by an opening in an orifice element for producing the fluid jet, the orifice element having an upstream portion, the passageway further having a converging section disposed upstream of the orifice for reducing turbulence in the passageway upstream of the orifice, the converging section extending toward the orifice element, a section having a rounded surface being disposed between the orifice element and the converging section and joining the converging section and the upstream portion of the orifice element, thereby providing a more cohesive fluid jet downstream of the orifice.

2. The apparatus recited in claim 1, wherein the rounded surface begins at a point upstream of the orifice element, and forms a continuous surface with the converging section, and furthermore forms a continuous surface with an upstream surface of the orifice element.

3. The apparatus recited in claim 1, wherein the rounded surface is a separate element from said housing.

4. The apparatus recited in claim 1, wherein said rounded surface comprises a metal.

5. The apparatus recited in claim 1, wherein said rounded surface comprises a roughened surface to further improve cohesiveness of the fluid jet.

6. The apparatus recited in claim 1, wherein said rounded surface comprises the surface of an adhesive used to secure the orifice element in the housing.

7. The apparatus recited in claim 1, wherein said rounded surface comprises the surface of a hardenable fluid formed to have said rounded surface.

8. The apparatus recited in claim 1, wherein said rounded surface is formed integrally with the orifice element.

9. The apparatus recited in claim 1, wherein the rounded surface comprises a spherical surface.

10. The apparatus recited in claim 9, wherein the spherical surface has a radius of curvature such that the spherical surface forms a tangent to said converging section at a point upstream of said orifice element and a tangent at a point on an upstream surface of the orifice element.

11. The apparatus recited in claim 1, wherein said converging section is disposed in the housing receiving the orifice, and the housing is a separate part from the supply tube.

12. A method for producing a highly cohesive fluid jet comprising:

receiving fluid under pressure through a supply tube;

providing a housing at the end of the supply tube having a passageway with an orifice formed by an opening in an orifice element in the passageway, the orifice opening having an upstream portion; and providing a converging section in the passageway upstream of the orifice for reducing turbulence in the fluid near the orifice, the converging section extending toward the orifice element, and further comprising providing a rounded surface between the converging section and the upstream portion of the opening of the orifice element, the rounded section joining the converging section and the orifice element upstream portion, thereby providing a more cohesive fluid jet downstream of the orifice.

13. The method recited in claim 12, further comprising providing the rounded surface so as to continuously flow into said converging section and so as to terminate adjacent said upstream portion of said orifice element thereby forming a continuous surface between the converging section and an upstream surface of the orifice element.

14. The method recited in claim 12, wherein the step of providing a rounded surface comprises providing a spherical surface.

15. The method recited in claim 14, wherein said step of providing a spherical surface comprises providing a spherical surface having a radius of curvature such that the spherical surface forms a tangent to said converging section at a point upstream of said orifice element and a tangent at a point on an upstream surface of said orifice element.

16. The method recited in claim 12, wherein said step of providing a rounded surface comprises providing an element having said rounded surface separate from said housing.

17. The method recited in claim 12, further comprising providing a roughened surface to the rounded surface.

18. The method recited in claim 12, wherein said step of providing a rounded surface comprises providing an element having said rounded surface comprising metal.

19. The method recited in claim 12, wherein said step of providing a rounded surface comprises providing a rounded surface comprising a substantially fluid material which subsequently hardens so as to have said rounded surface or which is formed to have said rounded surface.

20. The method recited in claim 12, wherein said rounded surface is formed integrally with the orifice element.

* * * * *

UNITED STATES PATENT AND TRADEMARK OFFICE

CERTIFICATE OF CORRECTION

PATENT NO. : 5,226,597

DATED : July 13, 1993

INVENTOR(S) : URSIC

It is certified that error appears in the above-identified patent and that said Letters Patent is hereby corrected as shown below:

Reference numeral "22" in Fig. 4 of the drawings should be "12", as per attached sheet.

The drawing sheet consisting of figues 4 and 5, should be deleted to appear as per attached sheet.

Signed and Sealed this

Third Day of January, 1995

Bruce Lehman

*Attest:*

BRUCE LEHMAN

*Attesting Officer*

*Commissioner of Patents and Trademarks*